US010059480B2

(12) United States Patent
Saccardi

(10) Patent No.: US 10,059,480 B2
(45) Date of Patent: Aug. 28, 2018

(54) LABELLING MACHINE WITH CARROUSEL

(71) Applicant: KOSME S.R.L. UNIPERSONALE, Roverbella (MN) (IT)

(72) Inventor: Giovanni Saccardi, Malavicina di Roverbella (IT)

(73) Assignee: KOSME S.R.L. UNIPERSONALE, Roverbella (IT)

( * ) Notice: Subject to any disclaimer, the term of this patent is extended or adjusted under 35 U.S.C. 154(b) by 473 days.

(21) Appl. No.: 14/905,165

(22) PCT Filed: Jul. 19, 2013

(86) PCT No.: PCT/IT2013/000202
§ 371 (c)(1),
(2) Date: Jan. 14, 2016

(87) PCT Pub. No.: WO2015/008304
PCT Pub. Date: Jan. 22, 2015

(65) Prior Publication Data

US 2016/0152368 A1 Jun. 2, 2016

(51) Int. Cl.
*B65C 9/06* (2006.01)

(52) U.S. Cl.
CPC ..... *B65C 9/06* (2013.01); *B65C 9/065* (2013.01)

(58) Field of Classification Search
CPC ..... B65C 9/06; B65C 9/065; B65C 9/067
See application file for complete search history.

(56) References Cited

U.S. PATENT DOCUMENTS 3,527,334 A * 9/1970 Wideman ..... B41F 17/18 198/379
4,529,469 A * 7/1985 Jorss ..... B65C 9/04 156/360
5,413,666 A 5/1995 Orlandi

FOREIGN PATENT DOCUMENTS

DE 75 23 323 U 11/1975
EP 0 608 668 A1 8/1994
EP 1 145 966 A1 10/2001
EP 1 911 678 A1 4/2008

* cited by examiner

*Primary Examiner* — Philip C Tucker
*Assistant Examiner* — John Blades
(74) *Attorney, Agent, or Firm* — Pearne & Gordon LLP

(57) ABSTRACT

A labelling machine with a carrousel comprises a carrousel (3) and a plurality of plates (4), mounted on the carrousel (3). Each plate (4) comprises supporting means (13) and a dragging element (14), comprising a tooth (15) substantially insertable in a recess made in the bottom of the container supported by the supporting means (13). The tooth (15) is off-centre relative to the first axis of rotation and movable relative to the supporting means (13) between an engaged position, in which the tooth (15) is substantially inserted in the recess, and a disengaged position, in which the tooth (15) is not associated with the recess. The machine (1) comprises for each plate (4) coupling means (41), operatively associated with the tooth (15), for coupling the supporting means (13) to the carrousel (3) when the tooth (15) is in the disengaged position, obstructing rotation of the supporting means (13) relative to the carrousel (3), and for uncoupling the supporting means (13) from the carrousel (3) when the tooth (15) is in the engaged position, allowing substantially free rotation of the supporting means (13) relative to the carrousel (3).

22 Claims, 13 Drawing Sheets

LABELLING MACHINE WITH CARROUSEL

DESCRIPTION

This invention relates to a labelling machine with a carrousel, of the type of labelling machines comprising a plurality of plates mounted on a rotary carrousel. Said machine is used for labelling containers, for example bottles, allowing one or more labels to be glued in the desired position on the lateral surface of such containers.

However, some containers are asymmetrical relative to their axis of extension, therefore, correct positioning of each label on a particular zone of the outer surface of such containers could be very complicated.

To overcome that problem, at the time of their production, on the bottom of the containers (for example glass bottles), a recess is made which is off-centre relative to the axis of extension. Said recess is designed to allow correct orientation of the asymmetrical container thanks to recognition of the position of the self-same recess, by suitable devices, so that the labels can subsequently be glued on the container in the correct position.

As is known, both in labelling machines with container orientation (for asymmetrical containers) and in labelling machines without container orientation (for symmetrical containers), the plates are mounted on a rotary carrousel and are driven by at least one motor-driven device. Therefore, each plate can perform rotations relative to the carrousel. The container supported by the plate is pressed onto the plate by thrust means, positioned on the carrousel supporting structure above each plate. Thanks to the rotation of each plate relative to the carrousel and the rotation of the carrousel about its axis of rotation, each container performs suitable movements in such a way that the labelling device can glue the labels on the containers supported by the various plates.

In the case of asymmetrical containers, each label must be glued on the container in a position which is clearly defined depending on the asymmetry of the container. Therefore, for this type of containers, the labelling machine must have additional features compared with a labelling machine for symmetrical containers.

Over time various solutions were developed for controlling the orientation of asymmetrical containers, through the interaction of a tooth projecting relative to the plate with the recess on the bottom of the container, to allow correct positioning of the containers for allowing the labels to be glued in a very precise position of the containers.

In the solution currently widely used each plate inferiorly comprises a fixed part, fixed to the carrousel, and superiorly comprises an annular semi-mobile part, which supports the container and is coupled friction-clutch-style to the fixed part, and a mobile part, positioned inside the semi-mobile part. The mobile part can rotate freely and independently of the other parts and comprises a projecting tooth, mobile relative to the mobile part thanks to a spring or other elastic means. When the container is pushed onto the plate by the thrust means, if the tooth is not at the recess, the bottom of the container presses it, shifting it downwards and overcoming the force applied by the elastic means on the tooth (that force tends to push the tooth upwards). Since the container is randomly positioned on the plate, it is at least unlikely that the tooth is at the recess at the moment when the container is pressed by the thrust means onto the plate and in particular onto the semi-mobile part of the plate.

After the container has been pushed onto the semi-mobile part by the thrust means, the mobile part (and therefore the tooth) is driven to rotate relative to the other parts In this way, by performing a rotation of at least a round angle, at a certain moment the tooth is definitely at the recess on the bottom of the container and at that moment is inserted in it. At that point, thanks to the mechanical hooking between the tooth and the container, as the mobile part rotates it drags the container with it, overcoming the friction guaranteed by the clutch.

It should be noticed that, after the tooth has been inserted in the recess, the container is dragged by the mobile part because the stress generated by the tooth on the bottom of the container can overcome the friction generated by the clutch and because the friction between the semi-mobile part and the container is greater than that generated by the clutch.

It should be noticed that, both the material of the semi-mobile part and the dimensions of the contact zone between the semi-mobile part and the container supported by it, are selected depending on the friction which must be guaranteed between the semi-mobile part and the container for correct operation of the machine.

Moreover, it should be noticed that, both the material and the dimensions of the clutch are selected depending on the friction which must be guaranteed by the self-same clutch based on the above indications.

When the friction guaranteed by the clutch is greater than the stresses which tend to cause rotation of the semi-mobile part (and therefore the container resting on it), the semi-mobile part and the container remain stationary relative to the carrousel. That happens before insertion of the tooth in the recess, when the stress generated by the tooth on the bottom of the container can overcome neither the friction between the semi-mobile part and the container, nor the friction guaranteed by the clutch. Therefore, before the tooth is inserted in the recess, both the semi-mobile part and the container remain stationary relative to the carrousel.

However, this prior art technology has several disadvantages.

In this prior art solution, the friction-clutch coupling of the semi-mobile part to the fixed part occurs thanks to continuous contact between the clutch element, associated with the fixed part, and the semi-mobile part (for example by means of a spring or other elastic means). However, during rotation of the mobile part after hooking with the container and the other rotations performed by the container during its time on the carousel, the clutch causes a continuous rubbing on the semi-mobile part. This rubbing on one hand causes significant wear of the self-same clutch and on the other hand overheating of the plate, in particular of the semi-mobile part.

In this context the technical purpose which forms the basis of this invention is to provide a labelling machine with a carrousel which overcomes the above-mentioned disadvantages.

The technical purpose of this invention is to provide a labelling machine with a carrousel whose plates are less subject to wear and overheating than in prior art machines.

The technical purpose specified and the aims indicated are substantially achieved by a labelling machine with a carrousel as described in the appended claims.

Further features and the advantages of this invention are more apparent in the detailed description, with reference to the accompanying drawings which illustrate a preferred, non-limiting embodiment of a labelling machine with a carrousel, in which:

FIG. 2 is a schematic partial plan view of the machine of FIG. 1, showing the sector where the recess is searched for;

Figure 1:
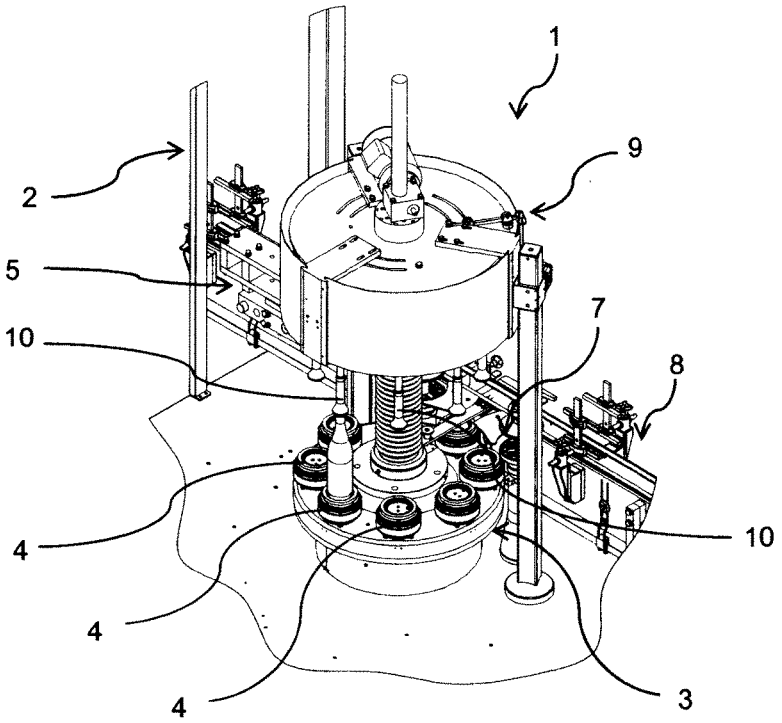
FIG. 1 is a schematic partial axonometric view of the machine according to this invention, without the labelling devices.

With reference to the accompanying drawings the numeral 1 denotes in its entirety a labelling machine with a carrousel according to this invention. The machine 1 comprises first a supporting structure 2, a carrousel 3 and a plurality of plates 4 which are mounted on the carrousel 3 (see FIG. 1). The carrousel 3 is rotatably mounted on the supporting structure 2 about an axis of rotation of the carrousel 3 and in use it can be driven to rotate by a main motor (of the known type and not illustrated in the accompanying drawings) connected to the carrousel 3.

The machine 1 also comprises at least one conveyor lane 5, substantially adjacent to the carrousel 3 for in use conveying the containers to be labelled towards the carrousel 3, at least one infeed pickup starwheel 6, positioned substantially between the carrousel 3 and the conveyor lane 5 for in use picking up the containers from the conveyor lane 5 and positioning them on one of the plates 4, and at least one labelling device (not illustrated in the accompanying drawings), positioned or positionable adjacent to the carousel 3 for in use gluing one or more labels on the container to be labelled.

Figure 2:
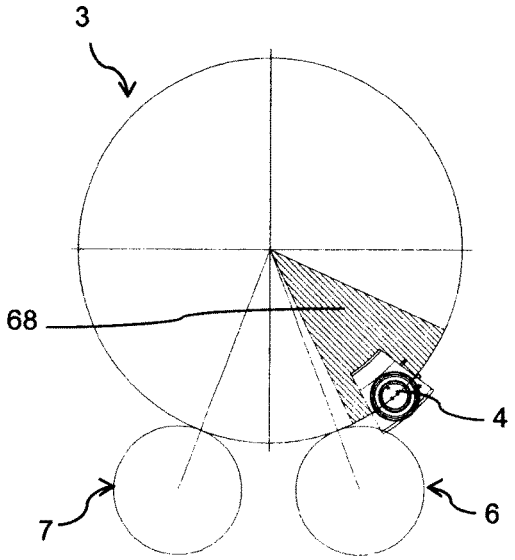

The machine 1 further comprises at least one outfeed pickup starwheel 7 (see FIG. 2), adjacent to the carrousel 3, for in use picking up the (labelled) containers from the plates 4 and positioning them on an outfeed path 8, positioned substantially adjacent to the carrousel 3 (see FIG. 2) and formed by the conveyor lane 5.

It should be noticed that the conveyor lane 5, the outfeed path 8, the infeed pickup starwheel 6 and the outfeed pickup starwheel 7 are of the known type and therefore are not described in detail.

Moreover, the machine 1 comprises an upper section 9 mounted on the supporting structure 2, positioned substantially above the carrousel 3 and rotatable relative to the supporting structure 2 about the axis of rotation of the carrousel 3 substantially synchronised with the carrousel 3.

The machine 1 further comprises thrust means 10 (see FIG. 1) of the known type (advantageously bell-shaped elements driven by elastic means or hydraulic cylinders or pneumatic cylinders are used), positioned or positionable in use above each container to be labelled. The thrust means 10 are mounted on the upper section 9, therefore in use they rotate together with the upper section 9.

In the embodiment illustrated, each plate 4 in use can be connected to a motor-driven device. During machine 1 operation, the motor-driven device allows rotation of part of the plate 4 connected to it relative to the carrousel 3 about a first axis of rotation. The first axis of rotation is, advantageously, substantially parallel with the axis of rotation of the carrousel 3. It should be noticed that, in use, each plate 4 advantageously performs a rotation with the carrousel 3 about the axis of rotation of the carrousel 3 and at least part of each plate 4 also performs a respective rotation relative to the carrousel 3 about the first axis of rotation.

In the embodiment illustrated, the carrousel 3 comprises, at each plate 4, an auxiliary motor 11 and a connecting element 12 for in use connecting the auxiliary motor 11 to that plate 4.

Therefore, in the case illustrated, the auxiliary motor 11 corresponds to the motor-driven device and at least part of each plate 4 is driven to rotate by means of an "electronic cam".

However, in other embodiments, it is also possible that the rotation of at least part of each plate 4 occurs not by means of an electronic cam mechanism, but rather by means of a mechanical cam mechanism driven by the main motor of the carrousel 3 (which therefore corresponds to the motor-driven device). It should be noticed that both the electronic cam mechanisms and mechanical cam mechanisms are of the known type and therefore are not described in detail.

In use, a container to be labelled is positionable on each plate 4, the container usually having asymmetry relative to an axis of extension of the self-same container and a known type of recess in the bottom. The containers positionable on the plates 4 are advantageously glass bottles, but they may also be made of different materials and may have different shapes. Advantageously, in the embodiment illustrated, each plate 4 is removably fixed to the carrousel 3. Therefore, each plate 4 can be removed from the carrousel 3 either to substitute it in the event of a fault, or to substitute it with a different type of plate 4 (for example a plate 4 traditionally used for labelling containers which are symmetrical relative to the axis of extension of the container).

Figure 3:
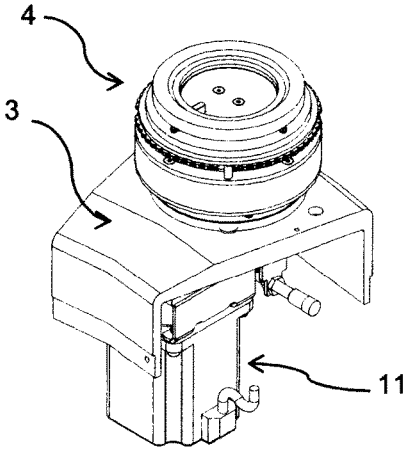
FIG. 3 is an axonometric cross-section of a detail of the machine of FIG. 1.
Figure 4:
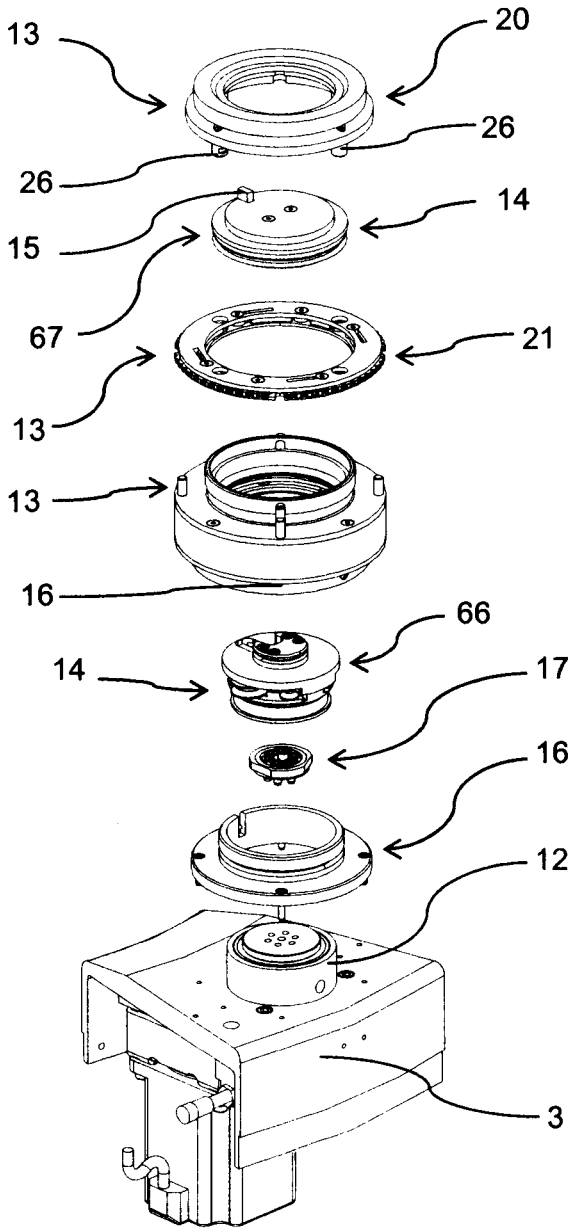
FIG. 4 is an exploded view of the detail of FIG. 3.

Each plate 4 must comprise supporting means 13 and a dragging element 14 comprising a tooth 15 (see FIGS. 3 and 4). In the embodiment illustrated, each plate 4 also comprises an anchoring element 16 and a timing device 17, which, however, may not be present in other embodiments. The anchoring element 16 advantageously allows the plate 4 to be anchored to the carrousel 3. In particular, in the embodiment illustrated, the anchoring element 16 is substantially ring-shaped and is mounted on the carrousel 3 substantially outside the connecting element 12. However, in other embodiments, the anchoring element 16 may have any shape provided that it is suitable for the purpose.

In contrast, the timing device 17 is mounted on the connecting element 12 to set the plate 4 timing. The expression "set the plate 4 timing" means to establish a reference position in which the tooth 15 (described in more detail below) is always in a predetermined position relative to the carrousel 3, so that the precise position of the tooth 15 relative to the carrousel 3 is always known.

In contrast, the supporting means 13 are mounted on the carrousel 3 (by means of the anchoring element 16 in the accompanying drawings) and are rotatable relative to the carrousel 3 about the first axis of rotation. Moreover, the supporting means 13 can in use be associated with a bottom of the container to be labelled and are used to in use support the container to be labelled.

In the embodiment illustrated, the rotation of the supporting means 13 relative to the carrousel 3 is guaranteed by a first bearing 18 positioned substantially between the supporting means 13 and the anchoring element 16. However, in other embodiments the first bearing 18 may be positioned substantially between the supporting means 13 and the carrousel 3 or it is also possible that the rotation of the supporting means 13 relative to the carrousel 3 is guaranteed by other systems/means provided that they are suitable for the purpose.

Advantageously, the supporting means 13 have an annular shape and the dragging element 14 (described in more detail below) is positioned inside the supporting means 13.

Figure 5:
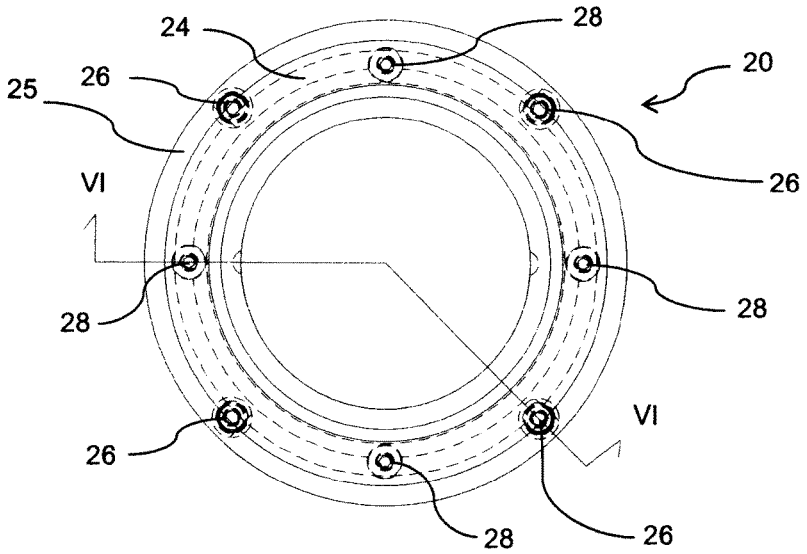
FIG. 5 is a plan view, with some parts transparent to better illustrate others, of the first element at the top illustrated in FIG. 4.

In the embodiment illustrated, the supporting means 13 comprise a lower portion 19, an upper portion 20 (illustrated in FIGS. 5 and 6) and an associating unit 21, interposed substantially between the upper portion 20 and the lower portion 19 for in use associating the upper portion 20 with the lower portion 19.

The lower portion 19 is advantageously rotatably mounted on the anchoring element 16 about the first axis of rotation and the rotation of the lower portion 19 relative to the anchoring element 16 is guaranteed by the first bearing 18. Advantageously, in the embodiment illustrated, the lower portion 19 is substantially ring-shaped.

In the embodiment illustrated, the lower portion 19 superiorly comprises a part having the shape of a hollow cylinder 22 (with axis substantially coinciding with the first axis of rotation), whose lateral surface is shaped to form an annular groove 23.

In contrast, the upper portion 20 and the associating unit 21 are advantageously slidably mounted on the lower portion 19.

It should be noticed that, in the embodiment illustrated, the upper portion 20 and the associating unit 21 are mobile relative to the lower portion 19, substantially axially, between an operating position and a non-operating position, in which the upper portion 20 and the associating unit 21 are further from the lower portion 19 than when the upper portion 20 and the associating unit 21 are in the operating position.

In the embodiment illustrated, the upper portion 20 advantageously comprises a clutch element 24 (see FIGS. 5 and 6) and a base 25, positioned substantially below the clutch element 24.

The clutch element 24 is advantageously ring-shaped and, in use, is in contact with the bottom of the container to be labelled.

Figure 6:
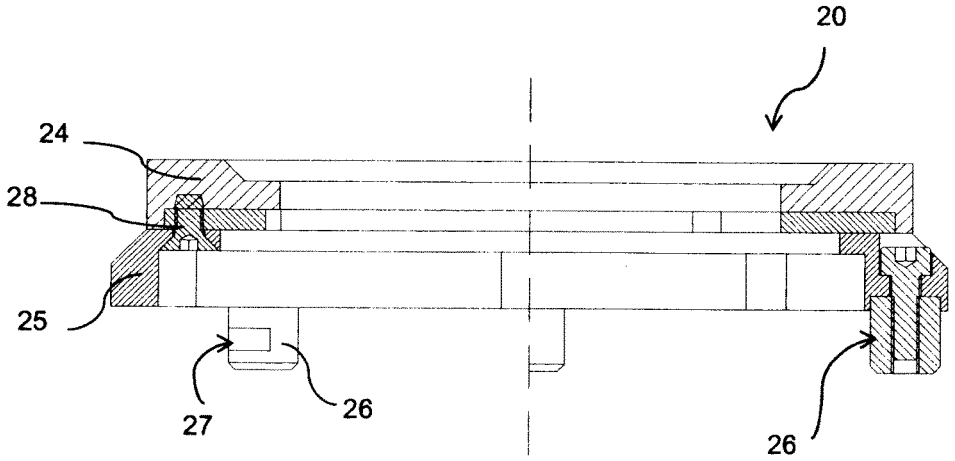
FIG. 6 is a cross-section of the element of FIG. 5 according to the line VI-VI.

The base 25 is preferably ring-shaped and comprises a plurality of first pins 26, substantially axial and each comprising a slit 27 substantially perpendicularly to the first axis of rotation (see FIG. 6). In the embodiment illustrated the base 25 is constrained to the clutch element 24 with first constraining means 28 (see FIG. 6). The first constraining means 28 advantageously comprise a plurality of screws, but in other embodiments the first constraining means 28 may be of different types provided that they are suitable for the purpose.

Figure 9:
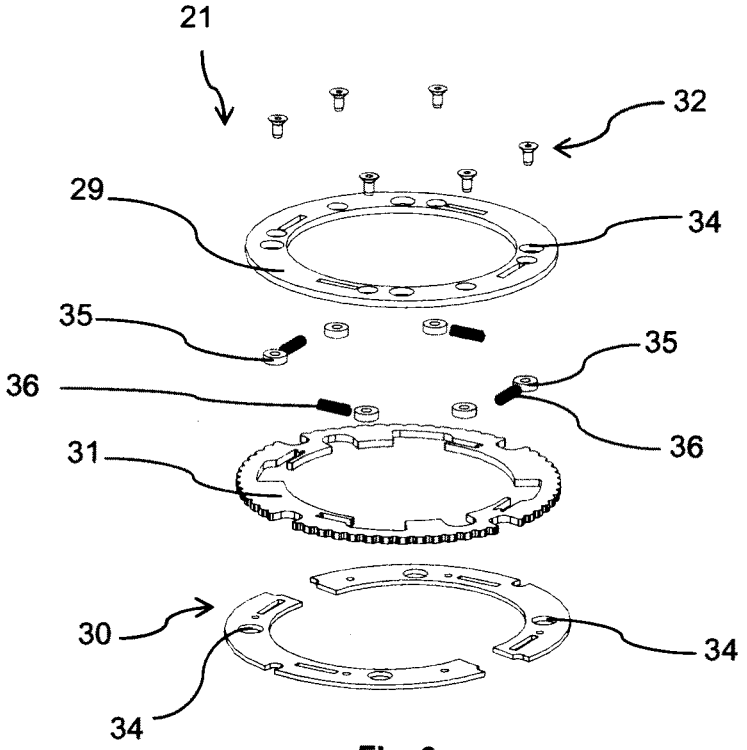
FIG. 9 is an exploded view of the third element from the top of FIG. 4.
Figure 10:
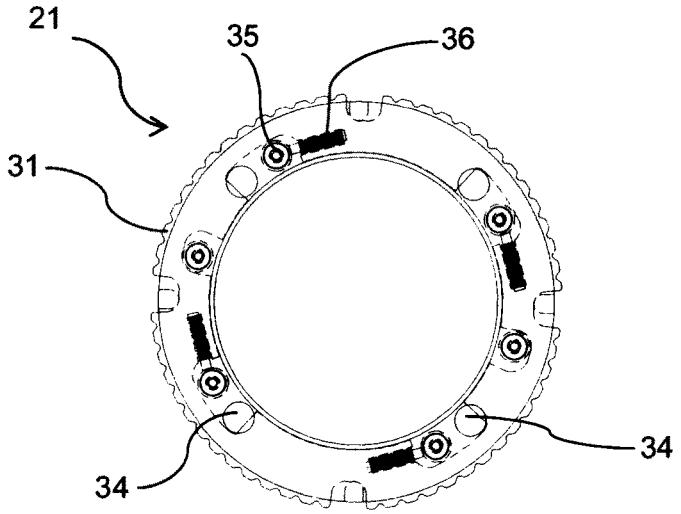
FIG. 10 is a plan view of the element of FIG. 9, with some parts transparent to better illustrate others.

In the embodiment illustrated, the associating unit 21 substantially comprises a first annular element 29, a second annular element 30 and a hoop 31 positioned between the first annular element 29 and the second annular element 30 (see FIGS. 9 and 10).

It should be noticed that the first annular element 29 is constrained to the second annular element 30 by second constraining means 32. In the embodiment illustrated, the second constraining means 32 advantageously comprise a plurality of screws, but in other embodiments the second constraining means 32 may be of different types provided that they are suitable for the purpose.

In the embodiment illustrated, the second annular element 30 is advantageously constituted of two circular half-crowns partly inserted in the annular groove 23 to prevent axial detachment of the associating unit 21 and the hollow cylinder 22.

It should be noticed that, in the embodiment illustrated, the thickness of the second annular element 30 is advantageously less than the dimension of the annular groove 23 parallel with the first axis of rotation; therefore, the second annular element 30 can advantageously slide axially in the annular groove 23 between a home position (see FIG. 19), in which the upper portion 20 and the associating unit 21 are in the non-operating position, and an operating position (see FIGS. 20 and 21), in which the upper portion 20 and the associating unit 21 are in the operating position.

It should be noticed that, in the embodiment illustrated, the second annular element 30 has an internal diameter which is less than that of the first annular element 29. Therefore, the first annular element 29 slides axially with the second annular element 30 relative to the annular groove 23, advantageously outside the annular groove 23.

It should also be noticed that the second annular element 30 advantageously cannot rotate about the first axis of rotation relative to the lower portion 19 of the supporting means 13 (thanks to the action of the second pins 33 described below).

The first annular element 29 and the second annular element 30 each comprise a plurality of holes 34 and each hole 34 of the first annular element 29 is positioned substantially at a hole 34 of the second annular element 30.

In use, the first pins 26 are inserted in said holes 34.

In the embodiment illustrated, the associating unit 21 also comprises a plurality of spacers 35 positioned between hoop 31 and the first annular element 29 at the second constraining means 32.

It should also be noticed that, parallel with the first axis of rotation, the spacers 35 have a height greater than the thickness of the hoop 31. Therefore, the hoop 31 may substantially move between the first annular element 29 and the second annular element 30 (as explained in more detail below).

In the embodiment illustrated, the associating unit 21 further comprises third elastic means 36, advantageously positioned between the spacers 35 and the hoop 31 in a plane substantially perpendicular to the first axis of rotation. The hoop 31 is advantageously rotatable about the first axis of rotation relative to the first annular element 29 and to the second annular element 30 by means of the third elastic means 36, overcoming the action of the third elastic means 36.

In the embodiment illustrated, the hoop 31 advantageously rotates between an interference position, in which the hoop 31 locks the first pins 26, if they are already inserted in the holes 34, or prevents insertion of the first pins 26 in the holes 34 if the first pins 26 are not already inserted in the holes 34 (see FIG. 10), and a non-interference position, in which the hoop 31 leaves the first pins 26 free to be inserted in the holes 34.

It should be noticed that, in the embodiment illustrated, when the first pins 26 are inserted in the holes 34, the hoop 31 in the interference position locks the first pins 26 by advantageously inserting itself in the slits 27 of the first pins 26; whilst when the hoop 31 is in the non-interference position it leaves the first pins 26 free to be removed.

It should be emphasised that, in other embodiments, the associating unit 21 may be of a type different to that described, provided that it is suitable for the purpose.

Figure 11:
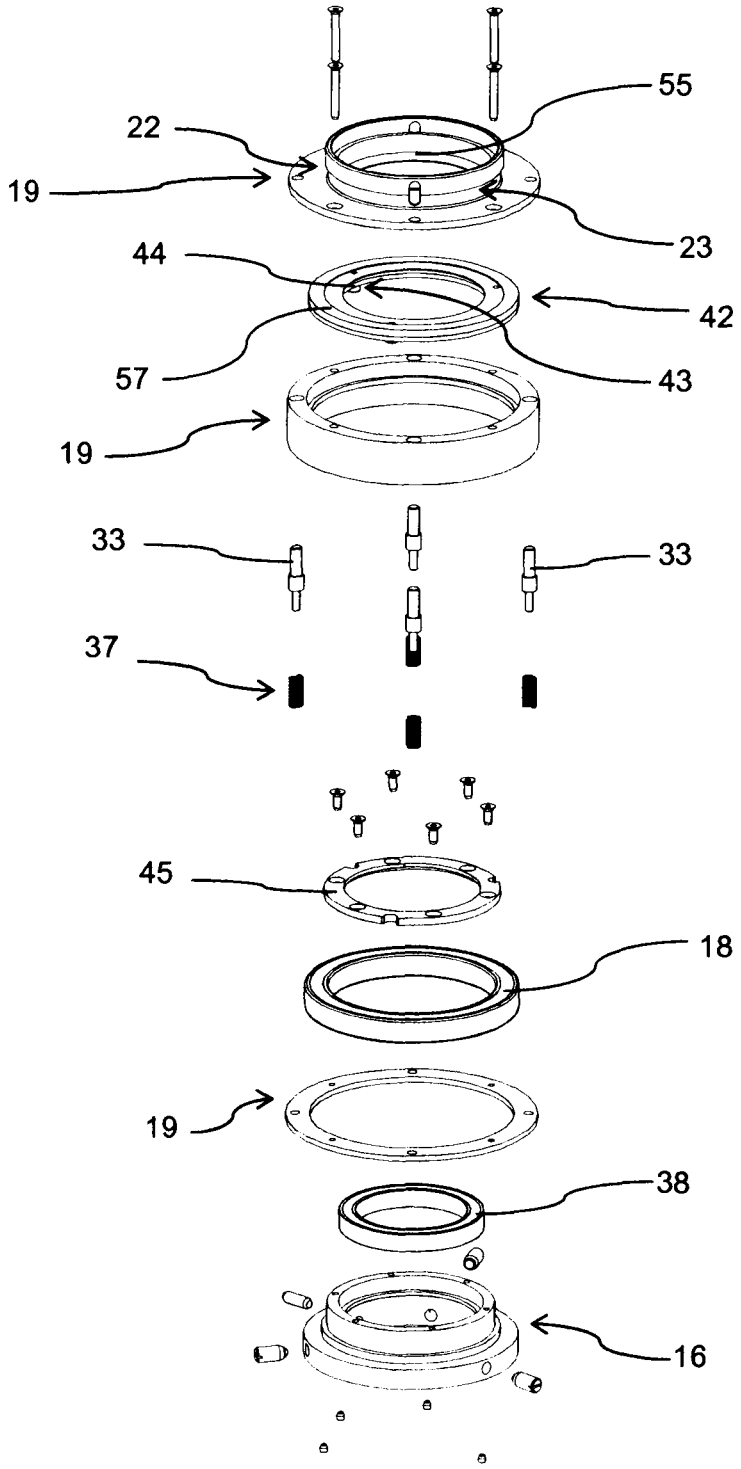
FIG. 11 is an exploded view of the fourth element from the top of FIG. 4.
Figure 12:
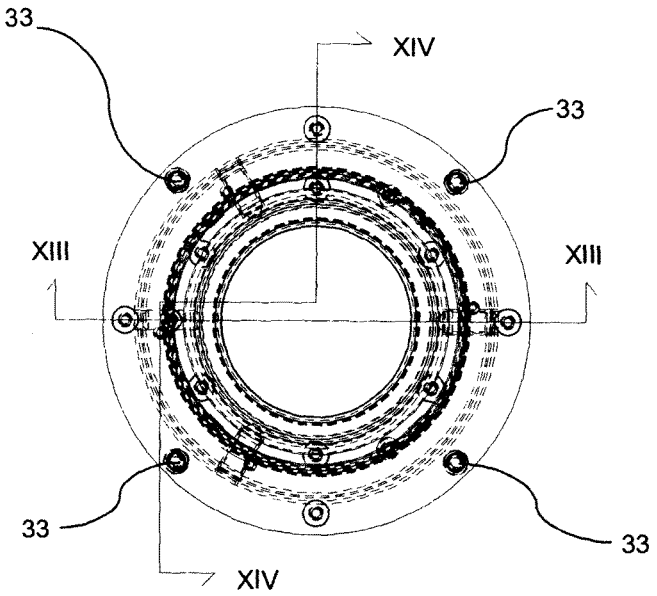
FIG. 12 is a plan view of the element of FIG. 11, with some parts transparent to better illustrate others.
Figure 19:
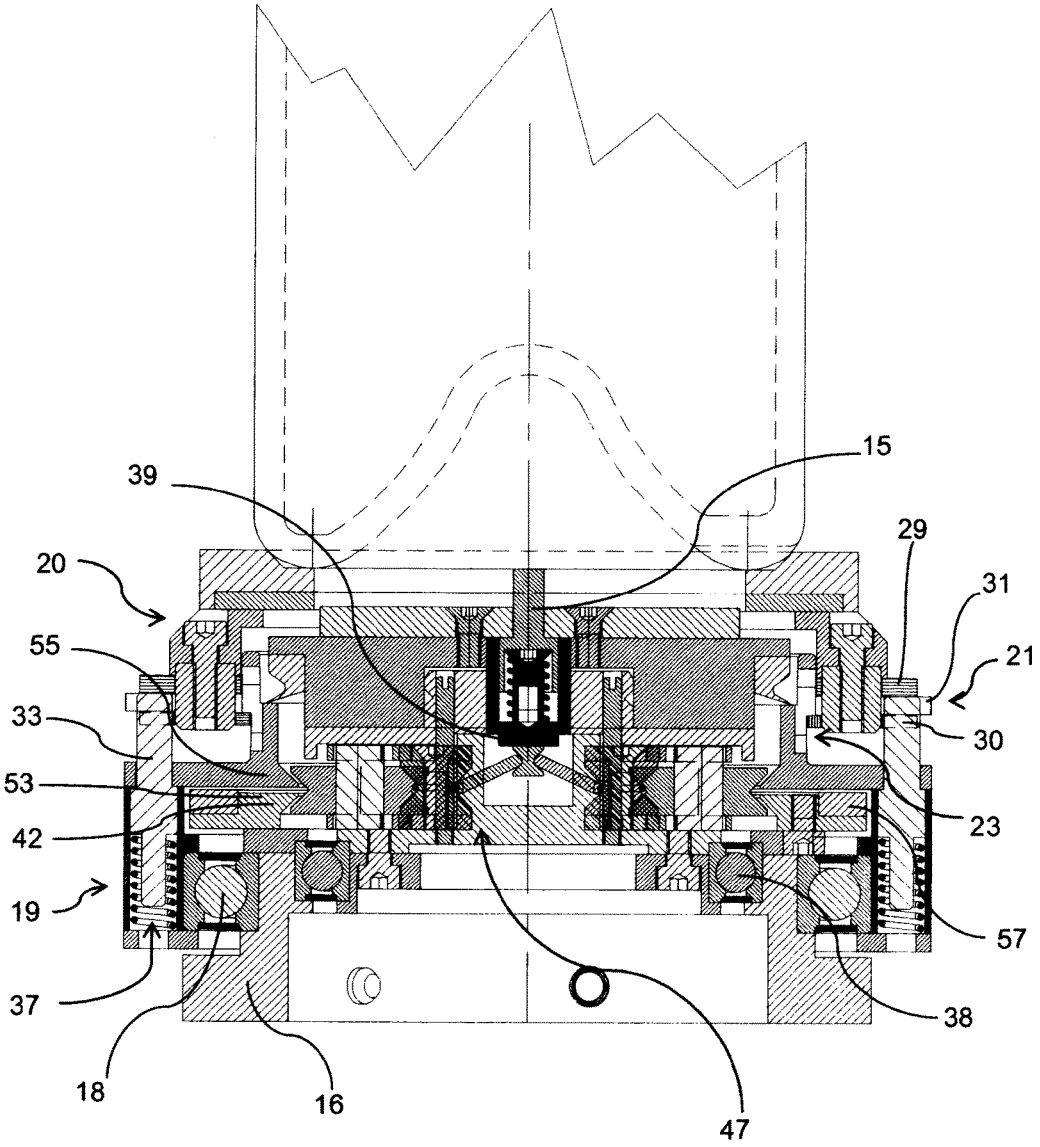
FIG. 19 is a schematic view of a first step of operation of the plate of FIG. 3, with the various parts in vertical section according to various overlapping section planes.

In the embodiment illustrated, there are second pins 33 associated with the upper portion 20 and the associating unit 21, said second pins being positioned substantially axially, slidably coupled to the lower portion 19 and advantageously associated with second elastic means 37, for example a plurality of springs (see FIGS. 11 and 19). The second elastic means 37 are positioned substantially between the second pins 33 and the lower portion 19 and act on the second pins 33 pushing the upper portion 20 and the associating unit 21 from the operating position towards the non-operating position (see FIGS. 19, 20 and 21).

It should be noticed that, in the embodiment illustrated, the second pins 33 are advantageously associated with the second annular element 30 to substantially prevent rotation of the second annular element 30 about the first axis of rotation relative to the lower portion 19 of the supporting means 13.

It should also be noticed that the associating unit 21 is preferably only resting on the second pins 33 so that, if the upper portion 20 and/or the associating unit 21 are subjected to forces with components that are not axial (not parallel with the first axis of rotation), the associating unit 21 can rotate relative to the second pins 33 (therefore avoiding breakage or bending of the second pins 33).

In contrast, as already indicated, the dragging element 14 comprises a tooth 15 substantially insertable in use in the recess made in the bottom of the container supported by the supporting means 13. As already indicated, asymmetrical containers are made with a recess on the bottom and recognition of the position of the recess allows angular orientation of the container to be labelled. Therefore, the recess provides a reference for orienting the container in a way suitable for subsequently gluing one or more labels on the container.

Furthermore, the dragging element 14 is rotatable relative to the supporting means 13 about the first axis of rotation independently of the supporting means 13. In the embodiment illustrated, the rotation of the dragging element 14 relative to the supporting means 13 about the first axis of rotation is driven by the motor-driven device and is guaranteed by a second bearing 38, positioned substantially between the dragging element 14 and the anchoring element 16 (solution illustrated) or the carrousel 3 (solution not illustrated).

Advantageously, the dragging element 14 is mounted on the timing device 17.

The tooth 15 of the dragging element 14 is movable relative to the supporting means 13 between an engaged position and a disengaged position.

In the engaged position, when the container is supported by the supporting means 13, the tooth 15 is substantially inserted, in use, in the recess made in the bottom of the container supported by the supporting means 13. In the disengaged position, when the container is supported by the supporting means 13, the tooth 15 is, in use, not in the recess made in the bottom of the container supported by the supporting means 13.

Preferably, the tooth 15 projects more towards the thrust means 10 in the engaged position than in the disengaged position.

In the embodiment illustrated, the tooth 15 moving between the engaged position and the disengaged position, advantageously moves substantially axially and therefore substantially parallel with the first axis of rotation. In the disengaged position (FIG. 20), the tooth 15 is therefore in a lower position than a higher position in which the tooth 15 is located when it is in the engaged position (FIG. 21).

However, in other embodiments, the tooth 15 may even move between the engaged position and the disengaged position in a different way (for example along a line substantially perpendicular or transversal to the first axis of rotation, or by rotating).

It should be noticed that the tooth 15 is off-centre relative to the first axis of rotation and is positioned at a distance from the first axis of rotation substantially corresponding to the distance, from the first axis of rotation, of the recess, made in the bottom of the container to be supported by the supporting means 13. In fact, the tooth 15 must be positionable at the recess made in the bottom of the container supported by the supporting means 13 in order to be able to be inserted in said recess.

It should also be noticed that the tooth 15 can be capable of insertion in the recess of containers having different dimensions, provided that the distance between the recess, made in the bottom of the container, and the first axis of rotation substantially corresponds to the distance between the tooth 15 and the first axis of rotation.

Advantageously, the dimensions of the tooth 15 are less than the space of the recess, therefore, in the engaged position, the tooth 15 can in use be inserted in the recess made in the bottom of the container supported by the supporting means 13. The tooth 15 may have a shape that is square, rounded or it may be of various shapes and/or types provided that they are suitable for the purpose.

Moreover, the tooth 15 inferiorly comprises a head 39 and, in the embodiment illustrated, is advantageously associated with an axial spring 40. In the embodiment illustrated, said axial spring 40 is compressed when the tooth 15 moves from the engaged position to the disengaged position, generating an axial elastic force which pushes the tooth 15 from the disengaged position towards the engaged position.

In other embodiments, said axial spring 40 may be substituted with elastic means of a different type, provided that they are suitable for the purpose of pushing the tooth 15 from the disengaged position towards the engaged position (or they may even not be present, as described below if other parts already guarantee that action).

The machine 1 according to this invention also comprises, for each plate 4, coupling means 41 operatively associated with the tooth 15.

The coupling means 41 couple the supporting means 13 to the carrousel 3 when the tooth 15 is in the disengaged position, obstructing rotation of the supporting means 13 relative to the carrousel 3 (in the conditions described in more detail below).

Moreover, the coupling means 41 uncouple the supporting means 13 from the carrousel 3 when the tooth 15 is in the engaged position allowing substantially free rotation of the supporting means 13 relative to the carrousel 3. In this situation, the supporting means 13 are substantially free to rotate about the first axis of rotation.

In the embodiment illustrated, the coupling means 41 comprise at least one coupling element 42. The coupling element 42 is coupled to the carrousel 3 or to the supporting means 13 and couplable respectively to the supporting means 13 or to the carrousel 3.

In the embodiment illustrated, the coupling element 42 is coupled to the carrousel 3 and couplable to the supporting means 13 and is mobile relative to the supporting means 13 between a coupled position and an uncoupled position.

It should be noticed that the coupling element 42 is coupled to the carrousel 3 at least in the coupled position, therefore, when the coupling element 42 is coupled to the supporting means 13, the supporting means 13 are coupled to the carrousel 3 by means of the coupling element 42.

In the embodiment illustrated, the coupling element 42 is preferably mobile relative to the supporting means 13, between said coupled position and said uncoupled position, substantially axially (therefore, substantially parallel with the first axis of rotation).

In the embodiment illustrated, in the coupled position, the coupling element 42 is coupled to the supporting means 13 for obstructing rotation of the supporting means 13 relative to the carrousel 3, in some conditions. In fact, in the coupled position, the coupling element 42 prevents rotation of the supporting means 13 relative to the carrousel 3 when the torque applied between the coupling element 42 (fixed to the carrousel 3) and the supporting means 13 is less than a predetermined value. Therefore, in the coupled position the coupling element 42, the supporting means 13 and the carrousel 3 form a single body which is stationary relative to the dragging element 14 at least when the torque applied between the coupling element 42 and the supporting means 13 is less than that predetermined value.

It should also be noticed that said predetermined value is established, first, depending on the static friction torque, generated between the bottom of the container supported by the supporting means 13 and the supporting means 13 and, as is known, that depends on the materials used, the contact surface area between the container and the supporting means 13 and the thrust applied by the thrust means 10 on the container.

Moreover, said predetermined value is established depending on the torque applied between the tooth 15 (and therefore the dragging element 14) and the bottom of the container when the tooth 15 is in the disengaged position and rubs on the bottom of the container due to the rotation of the dragging element 14. These points are also referred to below.

Furthermore, it should be noticed that when the coupling element 42 is in the coupled position it is in contact with the supporting means 13 and/or hooked to the supporting means 13. In the embodiment illustrated, in the coupled position the coupling element 42 is coupled to the supporting means 13 friction-clutch-style.

In contrast, in the uncoupled position the coupling element 42 is uncoupled from the supporting means 13 to allow substantially free rotation of the supporting means 13 relative to the carrousel 3. When the coupling element 42 is in the uncoupled position, the coupling element 42 is distanced and/or unhooked from the supporting means 13. The supporting means 13 are therefore substantially free to rotate relative to the coupling element 42 about the first axis of rotation, as explained above.

It should be noticed that, in the coupled position and in the uncoupled position, the coupling element 42 leaves the dragging element 14 substantially free to rotate relative to the supporting means 13 about the first axis of rotation. In the embodiment illustrated, in use, the dragging element 14 can therefore rotate, driven by the motor-driven device, irrespective of whether or not the coupling element 42 is in the coupled position or in the uncoupled position. In fact, the dragging element 14 must be substantially free to rotate, driven by the motor-driven device, independently of the coupling element 42 to guarantee correct machine 1 operation.

Figure 13:
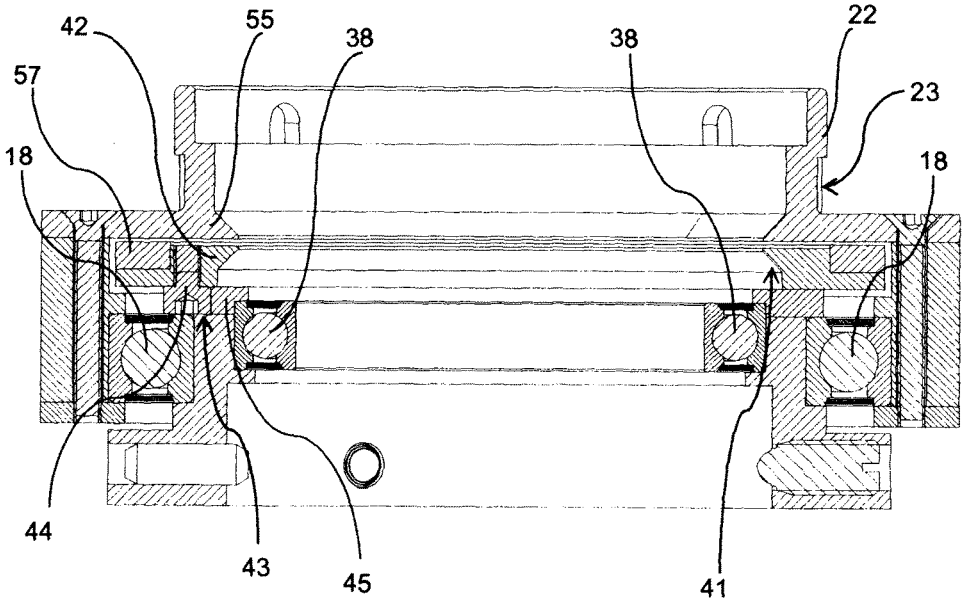
FIG. 13 is a schematic cross-section of the element of FIG. 12 according to the line XIII-XIII.

The machine 1 also comprises for each plate 4 rotation prevention means 43 for preventing rotation of the coupling element 42 relative to the carrousel 3 about the first axis of rotation. In fact, the rotation prevention means 43 are associated with the coupling element 42 (see FIGS. 11 and 13). In the embodiment illustrated, the rotation prevention means 43 are constituted of a plurality of rotation prevention pins 44 fixed to the coupling element 42 and axially slidably coupled to a third ring 45 fixed to the anchoring element 16 (solution illustrated) or to the carrousel 3 (solution not illustrated).

If the coupling element 42 were able to rotate relative to what it is associated with (the anchoring element 16 in the embodiment illustrated), then the machine 1 would not operate correctly.

In fact, in the embodiment illustrated, if the coupling element 42 were to rotate relative to the anchoring element 16, then the coupling element 42, the supporting means 13 and the carrousel 3 would not form a single body which is stationary relative to the dragging element 14. The container and the supporting means 13 could therefore rotate with the dragging element 14, not allowing the tooth 15 to be located at the recess at a certain moment. The above, with the necessary modifications, also applies if the coupling element 42 is coupled to the supporting means 13 (at least in the coupled position) and couplable to the carrousel 3.

Furthermore, the coupling means 41 comprise movement means 46 for moving the coupling element 42 between the uncoupled position and the coupled position, depending on the position of the tooth 15. In fact, the movement means 46 are operatively associated with the coupling element 42 and with the tooth 15.

Advantageously, the movement means 46 move the coupling element 42 from the uncoupled position to the coupled position and leave the coupling element 42 free to move from the coupled position to the uncoupled position. In the embodiment illustrated, the coupling element 42 moves from the coupled position to the uncoupled position under the effect of gravity. In other embodiments, the coupling element 42 may move from the coupled position to the uncoupled position in other ways and/or with other means suitable for the purpose, for example elastic means. This applies in particular in the case in which the passage from the uncoupled position to the coupled position involves the coupling element 42 shifting downwards.

In other embodiments it is also possible that the movement means 46 move the coupling element 42 not just from the uncoupled position to the coupled position, but also from the coupled position to the uncoupled position.

In the embodiment illustrated, the movement means 46 comprise at least one kinematic chain 47, operatively associated with the tooth 15 and with the coupling element 42. The kinematic chain 47 comprises at least two frames 48 and at least one wheel 49 mounted on each frame 48 (see FIGS. 15, 16, 17 and 18).

In particular, the two frames 48 are radially mobile relative to the first axis of rotation between a first position, closest to the first axis of rotation, and a second position, furthest from the first axis of rotation. In the embodiment illustrated, the movement means 46 also comprise a base element 50 which coincides with a lower part of the dragging element 14.

Advantageously, each frame 48 is slidably mounted on said base element 50 and is radially mobile relative to the base element 50 between the first position and the second position.

Regarding the wheels 49, the wheel 49 mounted one frame 48 is substantially diametrically opposed to the wheel 49 mounted on the other frame 48. Moreover, each wheel 49 is rotatable relative to the respective frame 48 about a respective axis of rotation.

It should be noticed that, in the embodiment illustrated, the axes of rotation of the wheels 49 are substantially parallel with the first axis of rotation.

In the embodiment illustrated, each frame 48 comprises two half-moon-shaped elements 51, positioned one above the other, and two hourglass-shaped elements 52, mounted between the two half-moon-shaped elements 51. In the embodiment illustrated, the wheel 49 is advantageously mounted between the two half-moon-shaped elements 51 and is positioned between the two hourglass-shaped elements 52.

It should be noticed that, in the embodiment illustrated, each wheel 49 is mounted on the frame 48 by means of a shaft 69 radially mobile relative to the frame 48. Advantageously, the shaft 69 is substantially parallel with the first axis of rotation (see FIGS. 15, 16 and 17). It should be noticed that preferably the two half-moon-shaped elements 51 each comprise an opening 71 extending radially and said openings 71 are substantially axially aligned (parallel with the first axis of rotation). Moreover, in the embodiment illustrated, the shaft 69 is slidably inserted in the two openings 71.

Advantageously, each frame 48 also comprises at least one leaf spring 70 mounted between the shaft 69 and one of the half-moon-shaped elements 51. The leaf spring 70 acts on the shaft 69 to push it radially outwards along the opening 71.

Figure 14:
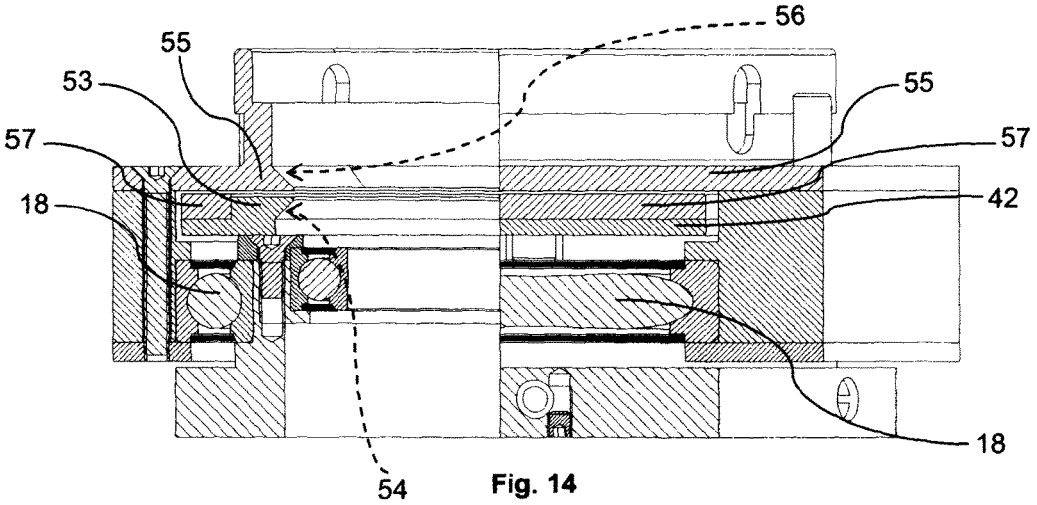
FIG. 14 is a schematic cross-section of the element of FIG. 12 according to the line XIV-XIV.

It should be noticed that, in the embodiment illustrated, the coupling element 42 is constituted of a first ring 53 (see FIG. 14) having a first inner edge 54 facing towards the first axis of rotation. Said first inner edge 54 extends substantially on the lateral surface of a truncated cone whose axis substantially coincides with the first axis of rotation.

Each wheel 49 is shaped to match at least said first inner edge 54 and converts a radial movement of the related frame 48 from the first position to the second position into an axial movement of the coupling element 42 from the uncoupled position to the coupled position.

It should be noticed that, when the frame 48 is in the first position the coupling element 42 is in the uncoupled position. In contrast, when the frame 48 is in the second position the coupling element 42 is in the coupled position.

It should also be noticed that, in the embodiment illustrated, the supporting means 13 comprise a second ring 55 (see FIGS. 13 and 14) opposite the first ring 53 and having a second inner edge 56 facing towards the first axis of rotation. Said second inner edge 56 extends substantially on the lateral surface of a truncated cone whose axis substantially coincides with the first axis of rotation.

It should also be noticed that, in the embodiment illustrated, the second ring 55 is included in particular in the lower portion 19 of the supporting means 13.

Figure 20:
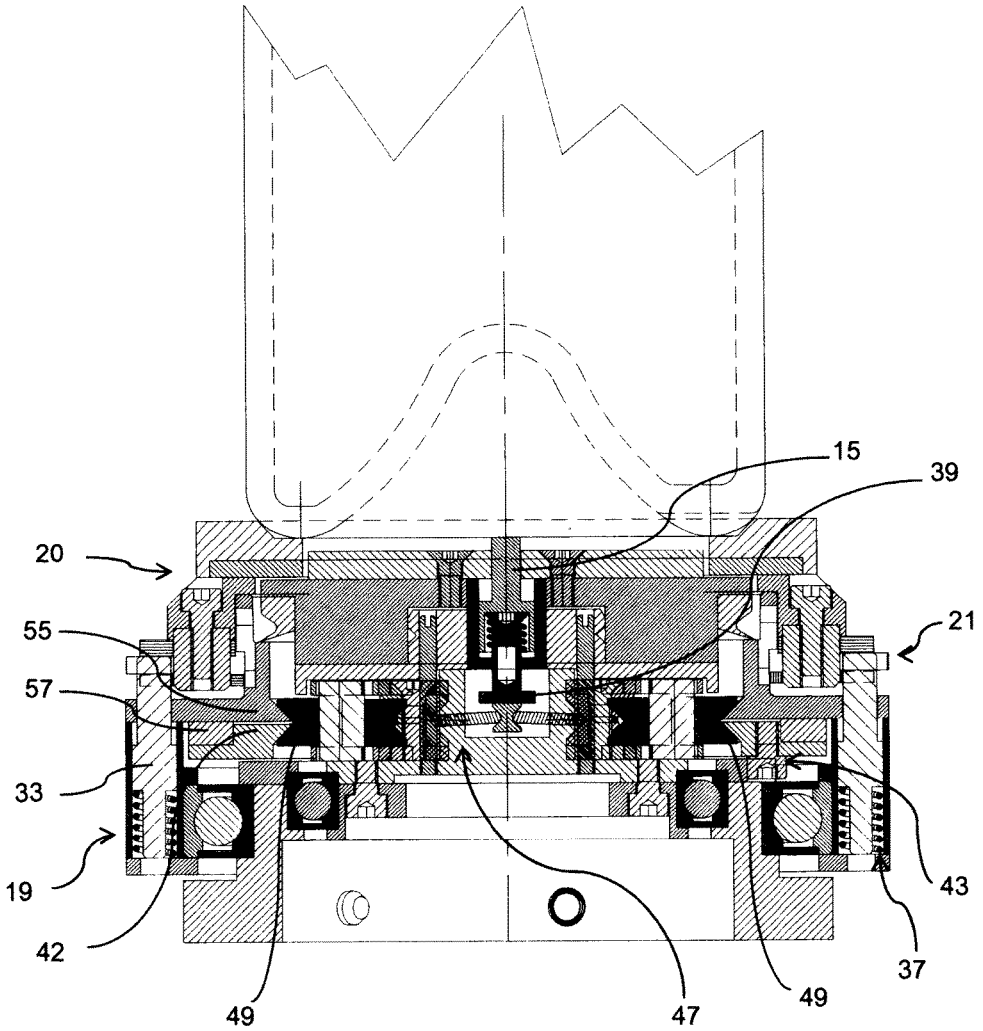
FIG. 20 is a schematic view of a second step of operation of the plate of FIG. 19.
Figure 21:
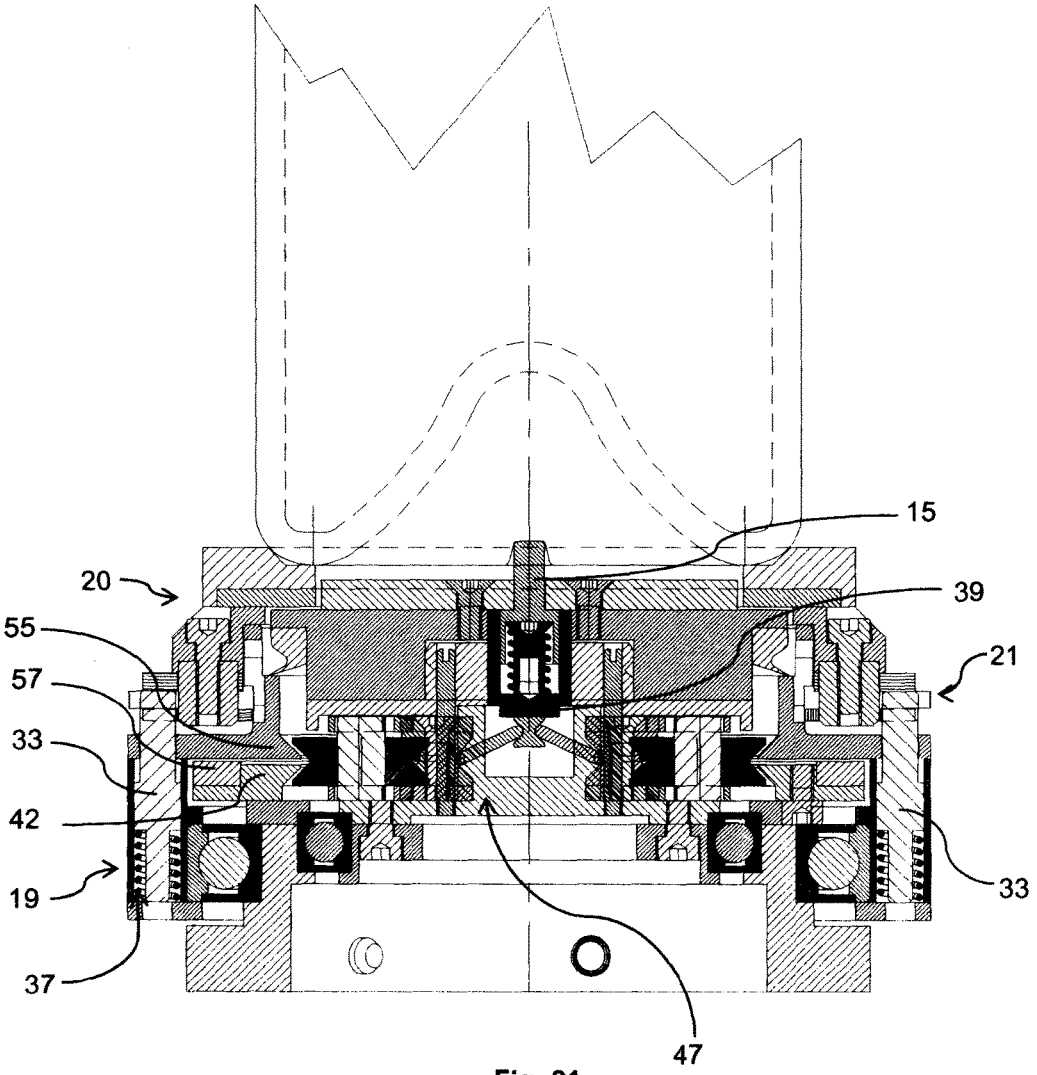
FIG. 21 is a schematic view of a third step of operation of the plate of FIG. 19.

In the embodiment illustrated, each wheel 49 is shaped to match not just the first inner edge 54, but also the second inner edge 56 for clamping the first ring 53 on the second ring 55 when the coupling element 42 is in the coupled position (see FIG. 20).

However, in other embodiments, each wheel 49 may have other shapes provided that they are suitable for the purpose.

In particular, in the embodiment illustrated, the wheels 49 advantageously have a concave profile (see FIG. 17) able to receive the first inner edge 54 and the second inner edge 56 for clamping the first ring 53 on the second ring 55.

However, in other embodiments the wheels 49 may have a different profile, for example with a projecting tip (solution not illustrated), for determining the passage of the coupling element 42 to the coupled position by divaricating it relative to a contact element.

Advantageously, each plate 4 further comprise at least one friction element 57, positioned between the first ring 53 and the second ring 55. The friction element 57 is clamped between the first ring 53 and the second ring 55 when the coupling element 42 is in the coupled position. The friction element 57 may always be in contact with the coupling element 42 (as in the embodiment illustrated) or with the second ring 55, irrespective of the position of the coupling element 42. In other embodiments the friction element 57 may not be in contact with the coupling element 42 or with the second ring 55 when the coupling element 42 is in the uncoupled position.

Figure 15:
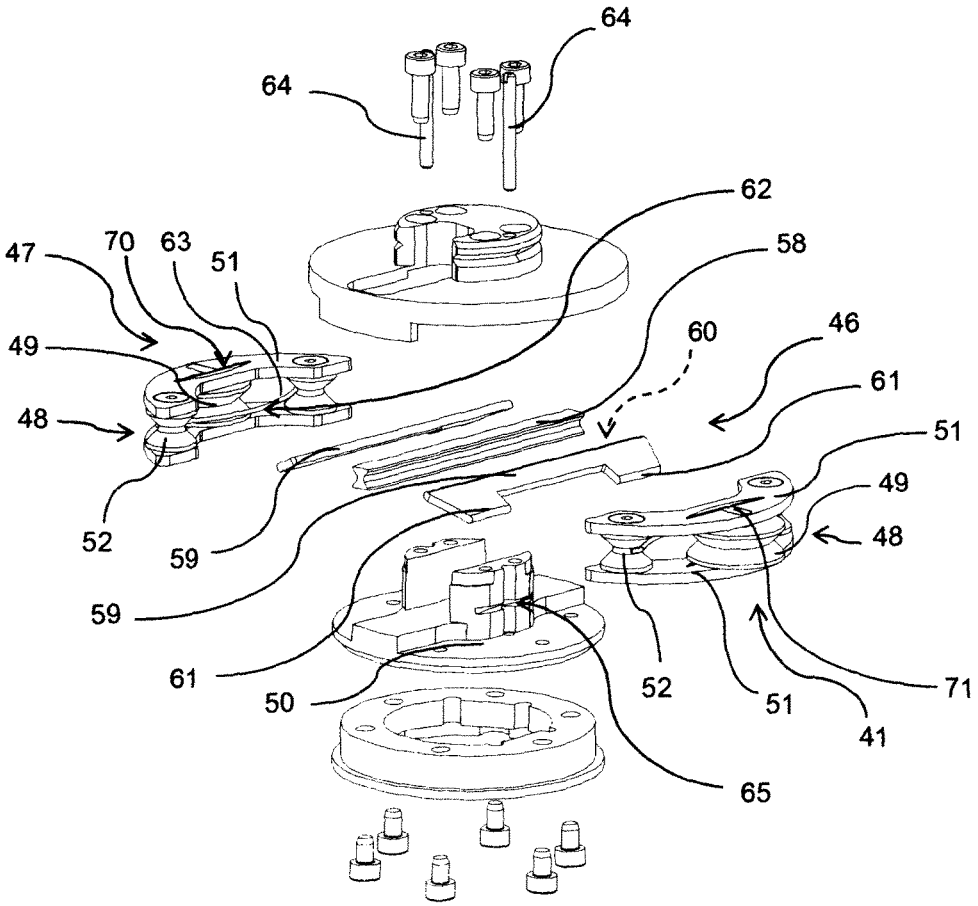
FIG. 15 is an exploded view of the fifth element from the top of FIG. 4.
Figure 17:
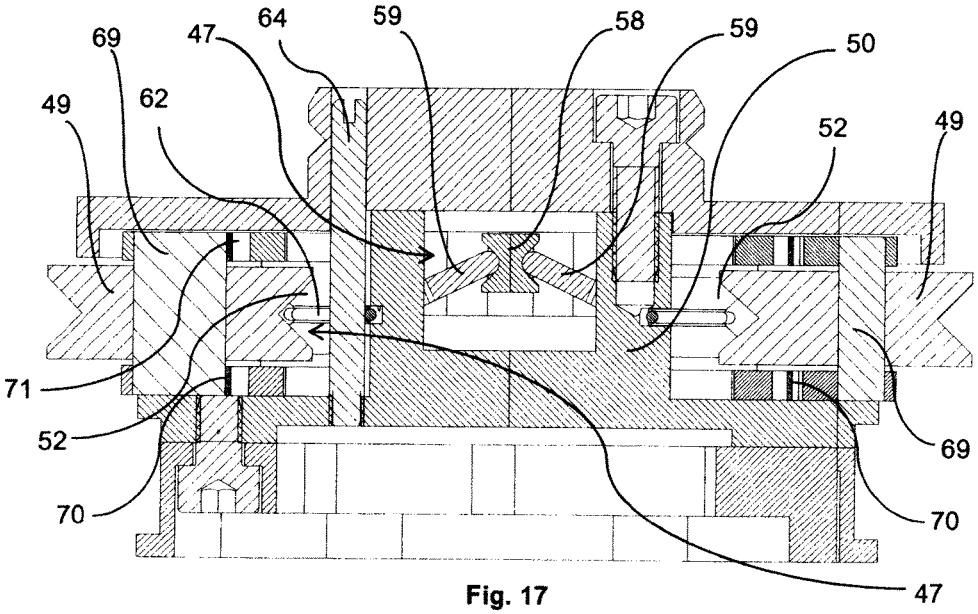
FIG. 17 is a cross-section of the element of FIG. 16 according to the line XVII-XVII.
Figure 18:
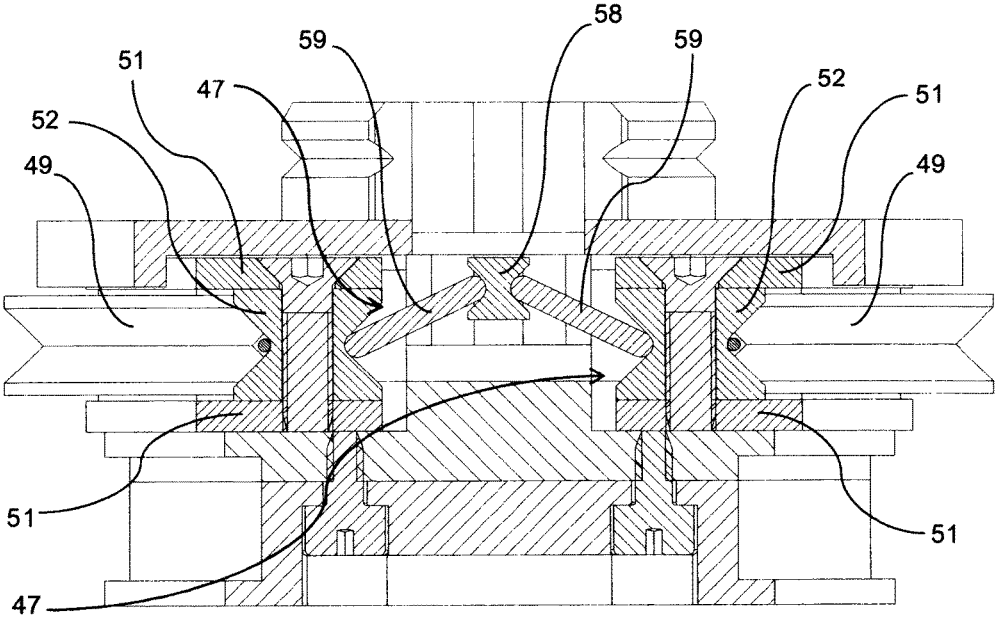
FIG. 18 is a cross-section of the element of FIG. 16 according to the line XVIII-XVIII.

Advantageously, the kinematic chain 47 also comprises an actuator element 58 and at least two wings 59 (see FIGS. 15, 17 and 18).

Said actuator element 58 is operatively associated with the tooth 15 and is mobile with the tooth 15 relative to the supporting means 13 between a raised position and a lowered position. When the actuator element 58 is in the raised position, the tooth 15 is in the engaged position. In contrast, when the actuator element 58 is in the lowered position, the tooth 15 is in the disengaged position (see FIGS. 19, 20 and 21).

In the embodiment illustrated, the head 39 of the tooth 15 advantageously moves the actuator element 58 from the raised position to the lowered position depending on the position of the tooth 15, by simple pressure.

It should be noticed that, in the embodiment illustrated, the actuator element 58 is preferably an elongate element and has, substantially axially, a cross-section with an hourglass-shaped profile (see FIGS. 15 and 17).

Each wing 59 is operatively associated with the actuator element 58 and with one of the frames 48. Each wing 59 is also rotatably mobile relative to the actuator element 58 between a near position and a projecting position. When the wings 59 are in the near position, the actuator element 58 is in the raised position and the frame 48 with which said wing 59 is associated is in the first position. In contrast, when the wings 59 are in the projecting position, the actuator element 58 is in the lowered position and the frame 48 with which said wing 59 is associated is in the second position.

Advantageously, in the embodiment illustrated, each wing 59 is "U"-shaped with a substantially flat base 60, in use inserted in the central zone of the hourglass-shaped profile of the actuator element 58, and with two ends 61 inserted in the sides of the two hourglass-shaped elements 52 (see FIG.

15). It should be noticed that, in the embodiment illustrated, the base 60 is rotatable relative to the actuator element 58 and the ends 61 are rotatable relative to the hourglass-shaped elements 52.

It should be noticed that, in the embodiment illustrated, thanks to the hourglass-shaped profile of the actuator element 58 and the hourglass-shaped elements 52, constraining elements (such as screws) are not needed to constrain each wing 59 respectively to the actuator element 58 and to the hourglass-shaped elements 52.

When the tooth 15 moves from the engaged position to the disengaged position, each wing 59 moves (in particular in the embodiment illustrated each wing 59 rotates about the actuator element 58) from the near position to the projecting position and the ends 61 of each wing 59 push the frame 48, with which said wing 59 is associated, from the first position to the second position. Consequently, each wheel 49 moves with the frame 48 on which it is mounted (therefore, radially relative to the first axis of rotation), approaching the coupling element 42 and moving the coupling element 42 from the uncoupled position to the coupled position.

At the moment when the wheel 49 has approached the coupling element 42 and has moved it from the uncoupled position to the coupled position, thanks to the fact that the shaft 69 can advantageously slide along the openings 71, the frame 48, moving further towards the second position, can overcome the resistance of the leaf spring 70 (which advantageously deforms) and shift relative to the shaft 69 which remains stationary. Consequently, there is relative motion of the shaft 69 along the opening 71, opposed by the leaf spring 70, until the frame 48 reaches the second position. The leaf spring 70 also pushes the wheel 49 towards the coupling element 42 and therefore guarantees that the coupling element 42 remains in the coupled position, as long as is necessary (therefore as long as the tooth 15 is in the disengaged position). In contrast, when the frame 48 moves from the second position towards the first position, the leaf spring 70, being deformed as indicated above, helps to push the frame 48 towards the first position and consequently to make the opening 71 slide relative to the shaft 69. When the shaft 69 reaches the end of the opening 71, it beings moving with the frame 48 and the wheel 49 releases the coupling element 42 which can return to the uncoupled position.

In the embodiment illustrated, each frame 48 advantageously comprises first elastic means 62 for pushing the frame 48 from the second position towards the first position. Said first elastic means 62 are connected between the frame 48 and the base element 50.

In the embodiment illustrated, the first elastic means 62 comprise a wire spring 63. However, in other embodiments, the first elastic means 62 may be of other types provided that they are suitable for the purpose.

Figure 16:
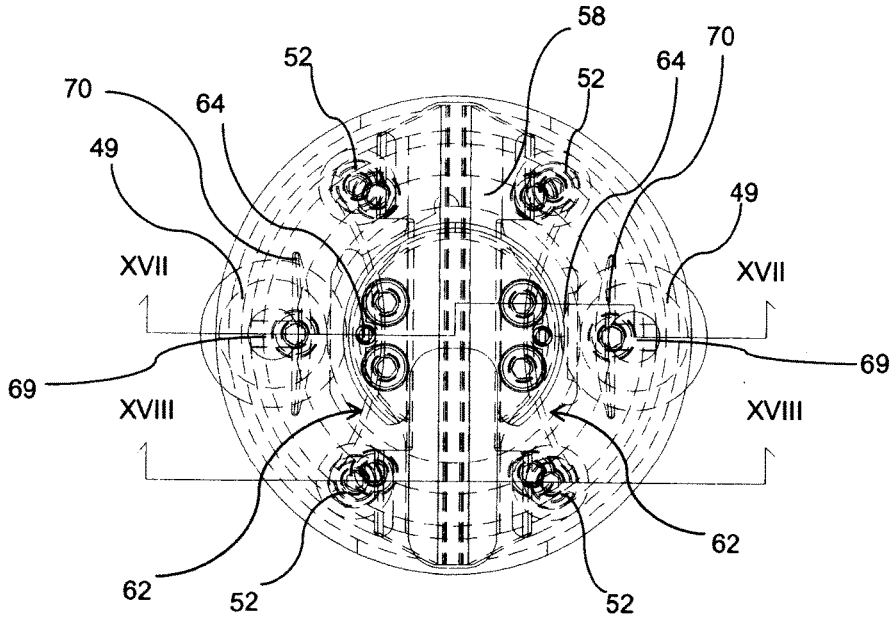
FIG. 16 is a schematic plan view of the element of FIG. 15, with some parts transparent to better illustrate others.

In particular, in the embodiment illustrated, the wire spring 63 is constrained at it centre to the base element 50 (by means of an axial pin 64 positioned substantially parallel with the first axis of rotation, visible in FIGS. 15, 16 and 17, which holds it in a housing 65 made in the base element 50), whilst the end parts act on the hourglass-shaped elements 52.

It should be noticed that, in the embodiment illustrated, the axial spring 40 may be absent if the first elastic means 62, in the absence of external stresses on the tooth 15, are able to shift the tooth 15 from the disengaged position to the engaged position.

Vice versa, in other embodiments, the first elastic means 62 may be absent if the kinematic chain 47 comprises constraining elements (for example hinges), for constraining the actuator element 58 to the wings 59 and each wing 59 to one of the frames 48, and the axial spring 40 is also able to return the frames 48 from the second position to the first position.

In the preferred embodiment illustrated, the machine 1 may be used for labelling containers having different dimensions.

In fact, the machine 1 comprises a plurality of interchangeable supporting means 13 with different dimensions to allow containers with substantially different sized bottoms to be placed on the supporting means 13.

The interchangeable supporting means 13 in particular comprise a common lower portion 19 and associating unit 21, and a plurality of separate upper portions 20 which can be coupled to the associating unit 21.

Furthermore, the machine 1 advantageously comprises a plurality of interchangeable dragging elements 14 with different dimensions.

It should be noticed that the movement means 46 are advantageously the same for said plurality of interchangeable dragging elements 14.

Figure 7:
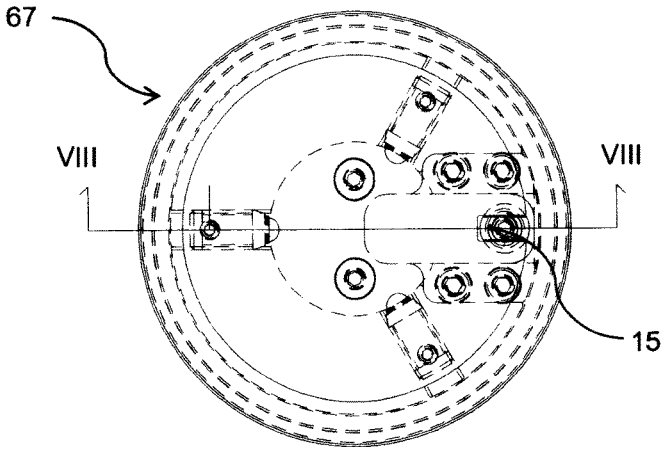
FIG. 7 is a plan view of the second element from the top in FIG. 4, with some parts transparent to better illustrate others.
Figure 8:
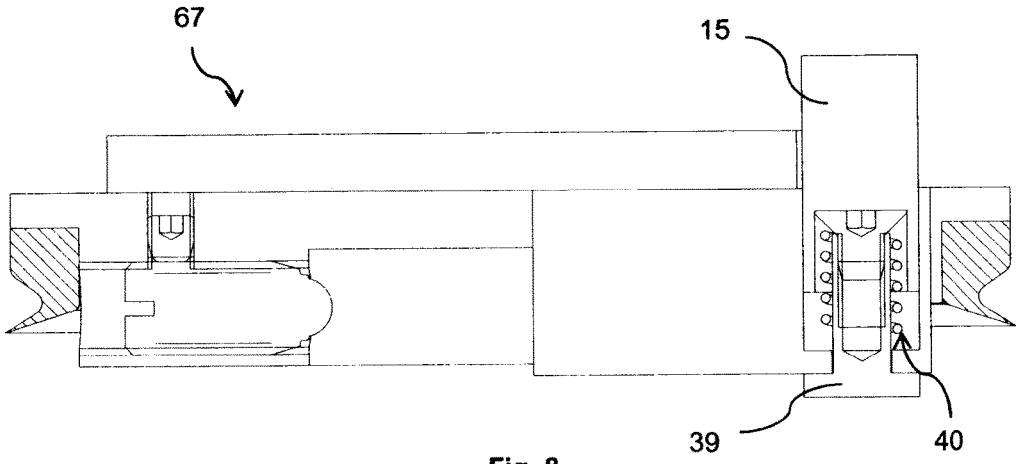
FIG. 8 is a cross-section of the element of FIG. 7 according to the line VIII-VIII.

The interchangeable dragging elements 14, in particular, comprise a common lower part 66 (which in the embodiment illustrated comprises the base element 50) and a plurality of separate upper parts 67 (see FIGS. 7 and 8), comprising the tooth 15, which can be coupled to the lower part 66. It should be noticed that, in the embodiment illustrated, thanks to the fact that the actuator element 58 is a diametrally elongate element, it is possible to change the dragging element 14 (and more precisely the upper part 67 of the dragging element 14) provided that the head 39 of the tooth 15 can apply a pressure on the actuator element 58, therefore being located substantially above and opposite the actuator element (therefore, in the embodiment illustrated, as long as the distance between the tooth 15 and the first axis of rotation is substantially not more than half of the length of the actuator element 58).

It should also be noticed that, in some cases, it is possible to interchange the supporting means 13 without the need to also change the dragging element 14, provided that the distance between the recess in the bottom of the various containers to be supported by the supporting means 13 and the first axis of rotation is substantially the same and corresponds to the distance between the tooth 15 and the first axis of rotation.

In contrast, in the other cases not only the supporting means 13, but also the dragging element 14 must be substituted to allow a container size change-over.

It should be noticed that, in the embodiment illustrated, the various parts of the plate 4, described above, may advantageously be connected by means of radial pegs, fixed to one part of the plate 4, which are inserted in related radial grooves made in one or more of the other parts of the plate 4. However, in other embodiments, the various parts of the plate 4 may be connected by other systems/means provided that they are suitable for the purpose.

Machine 1 operation in general is similar to that of prior art machines. In contrast, operation of the individual plates 4 derives from the structural description above and comprises the operating steps described below with reference to FIGS. 19, 20 and 21. It should be noticed that, in said Figures, the various parts illustrated are shown in cross-section according to various cross-section planes, parallel with the first axis of rotation or passing through the first axis of rotation, and they are overlapping to make operation of the plate 4 clearer.

During the first operating step, each container, in use, is picked up from the conveyor lane 5 by the infeed pickup starwheel 6 (see FIGS. 1 and 2) and is positioned on one of the plates 4 with random orientation. Therefore, the tooth 15 of the dragging element 14 is unlikely to be at the recess at the moment when the container is positioned on the plate 4.

It should be noticed that, during the first operating step, the upper portion 20 of the supporting means 13 and the associating unit 21 are in the non-operating position (see FIG. 19).

During the next step the thrust means 10 are operated, pushing the container, supported by the supporting means 13, towards said supporting means 13 (see FIG. 20). Therefore, the container is retained between the supporting means 13 and the thrust means 10.

Moreover, as a result of the thrust applied by the thrust means 10 on the container, the upper portion 20 and the associating unit 21 move from the non-operating position to the operating position.

Due to the thrust applied by the thrust means 10 on the container, the tooth 15 is pressed into the disengaged position by the bottom of the container. Advantageously, when the tooth 15 shifts towards the disengaged position, the container applies an axial force on the tooth 15 and the head 39 consequently applies a pressure on the actuator element 58. Therefore, the movement means 46 move the coupling element 42 from the uncoupled position to the coupled position.

At that point, with the coupling element 42 in the coupled position, the dragging element 14 is made to rotate.

In fact, during this operating step, the search for the recess takes place. The dragging element 14, in the search for recess sector 68, which corresponds to a predetermined initial angle of rotation of the carrousel 3 (see FIG. 2), performs at least one rotation of just over one round angle about the first axis of rotation to guarantee that at a certain moment the tooth 15 will be located at the recess. In other embodiments the search for recess sector 68 may be bigger or smaller than that schematically illustrated in FIG. 2.

The tooth 15 in the disengaged position is pushed by the axial spring 40 (or by the first elastic means 62) towards the bottom of the container and, moreover, rotates with the dragging element 14. The torque applied by the tooth 15 (and therefore the dragging element) to the bottom of the container (it should be noticed that the bottom of the containers has a predetermined roughness and may be knurled along a circular crown including the recess) is transmitted on a contact zone between the container and the supporting means 13. The consequent static friction torque established in the contact zone between the bottom of the container and the supporting means 13, as indicated, must be greater than the torque applied by the tooth 15 to the bottom of the container, so that the container cannot substantially slip on the supporting means 13. The torque applied by the tooth 15 to the bottom of the container is therefore also transmitted on a contact zone between the coupling element 42 and the supporting means 13 (second ring 55) and the consequent friction torque generated on the contact zone between the coupling element 42 and the supporting means 13 must be greater than the torque applied by the tooth 15 to the bottom of the container, so that the supporting means 13 cannot freely rotate about the first axis of rotation.

Therefore, the supporting means 13 remain stationary while the tooth 15 rotates (with the dragging element 14) remaining in the disengaged position. During the search for the recess, when the tooth 15 reaches the recess (see FIG. 21) it moves from the disengaged position to the engaged position. In particular, in the embodiment illustrated, the first elastic means 62 (and/or the axial spring 40 if present), in the absence of external stresses on the tooth 15, shift the tooth 15 into the engaged position. The movement means 46, move with the tooth 15, and in particular each wheel 49 moves away from the coupling element. The coupling element 42 then moves from the coupled position to the uncoupled position (in the preferred embodiment said movement of the coupling element 42 occurs under the effect of gravity). At that point the supporting means 13 are again free to rotate relative to the carrousel 3.

From that moment onwards, both in the final stretch of the search for recess sector 68, and for the entire remaining rotation of the carrousel 3, the dragging element 14 can rotate about the first axis of rotation, advantageously making the container (hooked to the tooth 15 at the recess) and the supporting means 13 rotate with it. Therefore, the container can rotate with the dragging element 14 and one or more labels can be glued on the container during the steps after the search for the recess.

It should be noticed that, in the meantime, the coupling element 42 is in the uncoupled position, therefore, during the rotations of the supporting means 13 relative to the carrousel 3, there is no wearing of the coupling element 42 (or of the first friction element 57 if present).

This invention brings important advantages.

In the labelling machine with a carrousel according to this invention, the plates are less subject to wear and overheating than in prior art machines.

Finally, it should be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and the materials used, as well as the shapes and dimensions of the various components, may vary according to requirements.

The invention claimed is:

1. A labelling machine with a carrousel comprising a carrousel (3) and a plurality of plates (4), each plate (4) being mounted on said carrousel (3) and comprising:

supporting means (13) for in use supporting a container to be labelled, said supporting means (13) being in use associable with a bottom of the container and being mounted on said carrousel (3), the supporting means (13) being rotatable relative to the carrousel (3) about a first axis of rotation; and a dragging element (14), comprising a tooth (15) substantially insertable in use in a recess made in the bottom of the container supported by the supporting means (13), said tooth (15) being movable relative to the supporting means (13) between an engaged position, in which in use the tooth (15) is substantially inserted in the recess, and a disengaged position, in which in use the tooth (15) is not associated with the recess, the dragging element (14) being rotatable about said first axis of rotation independently of said supporting means (13), and the tooth (15) being off-centre relative to the first axis of rotation;

characterised in that it comprises for each plate (4) coupling means (41), operatively associated with the tooth (15), for coupling the supporting means (13) to the carrousel (3) when the tooth (15) is in the disengaged position, obstructing rotation of the supporting means (13) relative to the carrousel (3), and for uncoupling the supporting means (13) from the carrousel (3) when the tooth (15) is in the engaged position, allowing substantially free rotation of the supporting means (13) relative to the carrousel (3).

2. The machine according to claim 1, wherein said coupling means (41) comprise a coupling element (42), couplable to the supporting means (13) and mobile relative to the supporting means (13) between a coupled position, in which the coupling element (42) is coupled to the supporting means (13) for obstructing rotation of the supporting means (13) relative to the carrousel (3), and an uncoupled position, in which the coupling element (42) is uncoupled from the supporting means (13) for allowing substantially free rotation of the supporting means (13) relative to the carrousel (3), the coupling element (42) being coupled to the carrousel (3) at least in the coupled position.

3. The machine according to claim 2, wherein in the coupled position the coupling element (42) is in contact with the supporting means (13) and/or is hooked to said supporting means (13), the coupling element (42), the supporting means (13) and the carrousel (3) forming a single body which is stationary relative to the dragging element (14) at least when the torque applied between the coupling element (42) and the supporting means (13) is less than a predetermined value, and in the uncoupled position the coupling element (42) is distanced from and/or unhooked from the supporting means (13), said supporting means (13) being substantially free to rotate relative to the coupling element (42) about the first axis of rotation.

4. The machine according to claim 2, wherein in the coupled position and in the uncoupled position the coupling element (42) leaves the dragging element (14) substantially free to rotate relative to the supporting means (13) about said first axis of rotation.

5. The machine according to claim 2, wherein the machine (1) comprises for each plate (4) rotation prevention means (43), associated with said coupling element (42), for preventing rotation about said first axis of rotation by said coupling element (42) respectively relative to the carrousel (3) or to the supporting means (13).

6. The machine according to claim 2, wherein the coupling means (41) comprise movement means (46), operatively associated with the coupling element (42) and with the tooth (15), for moving the coupling element (42) between the uncoupled position and the coupled position, depending on the position of the tooth (15).

7. The machine according to claim 6, wherein said movement means (46) move the coupling element (42) from the uncoupled position to the coupled position and leave the coupling element (42) free to move from the coupled position to the uncoupled position.

8. The machine according to claim 6, wherein the machine (1) comprises for each plate (4) rotation prevention means (43), associated with said coupling element (42), for preventing rotation about said first axis of rotation by said coupling element (42) respectively relative to the carrousel (3) or to the supporting means (13), and wherein the movement means (46) comprise a kinematic chain (47), operatively associated with the tooth (15) and with the coupling element (42) and comprising:

at least two frames (48) radially mobile relative to the first axis of rotation between a first position, closest to the first axis of rotation at which the coupling element (42) is in the uncoupled position, and a second position, furthest from the first axis of rotation at which the coupling element (42) is in the coupled position; and a wheel (49) mounted on each frame (48), the wheel (49) being mounted on one of the frames (48) substantially diametrically opposed to the wheel (49) mounted on the other frame (48), each wheel (49) being rotatable about a respective axis of rotation of the wheel (49) relative to the frame (48) on which said wheel (49) is mounted, the respective axis of rotation being substantially parallel with the first axis of rotation;

and wherein said coupling element (42) is a first ring (53), having a first inner edge (54) extending substantially on the lateral surface of a truncated cone whose axis substantially coincides with the first axis of rotation, each wheel (49) being shaped to match at least said first inner edge (54), each wheel (49) converting a radial movement from the first position to the second position of the frame (48) on which said wheel (49) is mounted, into an axial movement of the coupling element (42) from the uncoupled position to the coupled position.

9. The machine according to claim 8, wherein said kinematic chain (47) also comprises:

an actuator element (58), operatively associated with the tooth (15) and mobile with the tooth (15) relative to the supporting means (13) between a raised position, corresponding to the engaged position of the tooth (15), and a lowered position, corresponding to the disengaged position of the tooth (15);

at least two wings (59), each wing (59) being operatively associated with said actuator element (58) and with one of the frames (48) and being mobile relative to the actuator element (58) between a near position, where the actuator element (58) is in the raised position and the frame (48) with which said each wing (59) is associated is in the first position, and a projecting position, where the actuator element (58) is in the lowered position and the frame (48) with which said each wing (59) is associated is in the second position.

10. The machine according to claim 8, wherein the movement means (46) comprise a base element (50), each frame (48) being mounted on said base element (50) and being radially mobile relative to the base element (50) between said first position and said second position, each frame (48) comprising first elastic means (62), connected between said frame (48) and the base element (50), for pushing said frame (48) from the second position towards the first position.

11. The machine according to claim 8, wherein the supporting means (13) comprise a second ring (55), opposite the first ring (53) and having a second inner edge (56) extending substantially on the lateral surface of a truncated cone whose axis substantially coincides with the first axis of rotation, each wheel (49) also being shaped to match said second inner edge (56) for clamping said first ring (53) on said second ring (55) when the coupling element (42) is in the coupled position.

12. The machine according to claim 11, wherein each plate (4) comprises a friction element (57), positioned between the first ring (53) and the second ring (55), the friction element (57) being clamped between the first ring (53) and the second ring (55) when the coupling element (42) is in the coupled position.

13. The machine according to claim 6, wherein the machine (1) comprises a plurality of interchangeable dragging elements (14) having different dimensions and wherein the movement means (46) are the same for said plurality of interchangeable dragging elements (14).

14. The machine according to claim 1, wherein said coupling means (41) comprise a coupling element (42), couplable to the carrousel (3) and mobile relative to the carrousel (3) between a coupled position, in which the coupling element (42) is coupled to the carrousel (3) for obstructing rotation of the supporting means (13) relative to the carrousel (3), and an uncoupled position, in which the coupling element (42) is uncoupled from the carrousel (3) to allow substantially free rotation of the supporting means (13) relative to the carrousel (3), the coupling element (42) being coupled to the supporting means (13) at least in the coupled position.

15. The machine according to claim 14, wherein in the coupled position the coupling element (42) is in contact with the carrousel (3) and/or hooked to the carrousel (3), the coupling element (42), the supporting means (13) and the carrousel (3) forming a single body which is stationary relative to the dragging element (14) at least when the torque applied between the coupling element (42) and the carrousel (3) is less than a predetermined value, and in the uncoupled position the coupling element (42) is distanced from and/or unhooked from the carrousel (3), said supporting means (13) being substantially free to rotate relative to the coupling element (42) about the first axis of rotation.

16. The machine according to claim 14, wherein in the coupled position and in the uncoupled position the coupling element (42) leaves the dragging element (14) substantially free to rotate relative to the supporting means (13) about said first axis of rotation.

17. The machine according to claim 14, wherein the machine (1) comprises for each plate (4) rotation prevention means (43), associated with said coupling element (42), for preventing rotation about said first axis of rotation by said coupling element (42) respectively relative to the carrousel (3) or to the supporting means (13).

18. The machine according to claim 14, wherein the coupling means (41) comprise movement means (46), operatively associated with the coupling element (42) and with the tooth (15), for moving the coupling element (42) between the uncoupled position and the coupled position, depending on the position of the tooth (15).

19. The machine according to claim 1, wherein the supporting means (13) have an annular shape and the dragging element (14) is positioned inside said supporting means (13).

20. The machine according to claim 1, wherein the machine (1) comprises a plurality of interchangeable supporting means (13) having different dimensions.

21. The machine according to claim 1, wherein the machine (1) comprises a plurality of interchangeable dragging elements (14) having different dimensions.

22. The machine according to claim 1, wherein each plate (4) is removably fixed to the carrousel (3).

* * * * *